US009263783B2

(12) United States Patent
Kroening

(10) Patent No.: US 9,263,783 B2
(45) Date of Patent: Feb. 16, 2016

(54) WAVEGUIDE CIRCULATOR HAVING STEPPED FLOOR/CEILING AND QUARTER-WAVE DIELECTRIC TRANSFORMER

(71) Applicant: Honeywell International Inc., Morristown, NJ (US)

(72) Inventor: Adam M. Kroening, Atlanta, GA (US)

(73) Assignee: Honeywell International Inc., Morris Plains, NJ (US)

( * ) Notice: Subject to any disclaimer, the term of this patent is extended or adjusted under 35 U.S.C. 154(b) by 142 days.

(21) Appl. No.: 14/159,824

(22) Filed: Jan. 21, 2014

(65) Prior Publication Data

US 2015/0207196 A1 Jul. 23, 2015

(51) Int. Cl.
*H01P 1/39* (2006.01)
*H01P 1/38* (2006.01)

(52) U.S. Cl.
CPC ... *H01P 1/38* (2013.01); *H01P 1/39* (2013.01)

(58) Field of Classification Search
CPC ..... H01P 1/32; H01P 1/39; H01P 1/383; H01P 1/38
USPC ..... 333/1.1, 24.2
See application file for complete search history.

(56) References Cited

U.S. PATENT DOCUMENTS

| | | | |
|---|---|---|---|
| 3,038,131 | A | 6/1962 | Uebele et al. |
| 3,080,536 | A | 3/1963 | Dewhirst |
| 3,188,582 | A | 6/1965 | Bowness |
| 3,231,835 | A | 1/1966 | Nielsen et al. |
| 3,334,317 | A | 8/1967 | Andre |
| 3,341,789 | A | 9/1967 | Goodman et al. |
| 3,355,679 | A | 11/1967 | Carr |
| 3,492,601 | A | 1/1970 | Omori |
| 3,534,276 | A | 10/1970 | Berteaud et al. |
| 4,058,780 | A | 11/1977 | Riblet |
| 4,496,915 | A | 1/1985 | Mathew et al. |
| 4,697,158 | A | 9/1987 | Hoover et al. |
| 4,801,902 | A | 1/1989 | Hoover et al. |

(Continued)

FOREIGN PATENT DOCUMENTS

| | | |
|---|---|---|
| EP | 1187250 | 3/2002 |
| EP | 1730808 | 12/2006 |

(Continued)

OTHER PUBLICATIONS

European Patent Office, "Extended European Search Report from EP Application No. 14190529.9 mailed Jun. 10, 2015", from Foreign Counterpart of U.S. Appl. No. 14/159,824, filed Jun. 10, 2015, pp. 1-6, Published in: EP.

*Primary Examiner* — Stephen E Jones
(74) *Attorney, Agent, or Firm* — Fogg & Powers LLC

(57) ABSTRACT

In an example, a circulator is disclosed. The circulator includes a waveguide housing having a plurality of hollow waveguide arms that communicate with a central cavity. The waveguide arms include, and the central cavity is defined by, a floor, a ceiling, and a plurality of sidewalls connected between the floor and the ceiling. At least one of the floor or the ceiling includes at least one step which defines a junction between a first region having a first height between the floor and the ceiling and one or more second regions having a second height between the floor and the ceiling. The first region is proximate the central cavity and the one or more second regions are proximate the waveguide arms. The first height is larger than the second height.

20 Claims, 8 Drawing Sheets

(56) References Cited

U.S. PATENT DOCUMENTS

| | | | |
|---|---|---|---|
| 6,885,257 | B2 | 4/2005 | Kroening |
| 6,891,446 | B2 | 5/2005 | Tayrani et al. |
| 7,049,900 | B2 | 5/2006 | Kroening |
| 7,242,263 | B2 | 7/2007 | Kroening |
| 7,280,004 | B2 | 10/2007 | Kroening |
| 7,561,003 | B2 | 7/2009 | Kroening |
| 7,683,731 | B2 | 3/2010 | Kroening |
| 7,746,189 | B2 | 6/2010 | Hocine et al. |
| 8,324,990 | B2 | 12/2012 | Vouloumanos |
| 2010/0207701 | A1 * | 8/2010 | Ikoma ..... H01P 1/39 333/1.1 |

FOREIGN PATENT DOCUMENTS

| | | |
|---|---|---|
| EP | 1997184 | 12/2008 |
| WO | 02067361 | 8/2002 |
| WO | 03041213 | 5/2003 |
| WO | 2005114775 | 12/2005 |
| WO | 2006113381 | 10/2006 |
| WO | 2008105755 | 9/2008 |

* cited by examiner

WAVEGUIDE CIRCULATOR HAVING STEPPED FLOOR/CEILING AND QUARTER-WAVE DIELECTRIC TRANSFORMER

GOVERNMENT LICENSE RIGHTS

This invention was made with Government support under H94003-04-D0005 awarded by AFRL. The Government has certain rights in the invention.

BACKGROUND

Waveguide circulators typically have a waveguide housing that defines a central cavity and three waveguide arms extending from the central cavity. A ferrite element is located in the central cavity to increase coupling between the arms. The central cavity and three waveguide arms are typically defined by a floor, a ceiling, and a plurality of sidewalls. In such waveguide circulators the dimensions of the central cavity and three waveguide arms are based on the desired frequency range of operation. The height between the floor and ceiling is constant throughout the central cavity and the three waveguide arms provide high quality coupling between the waveguide arms and the central cavity and enable easier manufacturing.

SUMMARY

In an example, a circulator is disclosed. The circulator includes a waveguide housing having a plurality of hollow waveguide arms that communicate with a central cavity. The waveguide arms include, and the central cavity is defined by, a floor, a ceiling, and a plurality of sidewalls connected between the floor and the ceiling. At least one of the floor or the ceiling includes at least one step which defines a junction between a first region having a first height between the floor and the ceiling and one or more second regions having a second height between the floor and the ceiling. The first region is proximate the central cavity and the one or more second regions are proximate the waveguide arms. The first height is larger than the second height. The circulator also includes a ferrite element disposed in the central cavity of the waveguide housing. The ferrite element includes a plurality of arms corresponding to the plurality of hollow waveguide arms. The circulator also includes one or more quarter-wave dielectric transformers attached to the ferrite element. Each quarter-wave dielectric transformer protrudes from a respective arm of the ferrite element into a respective waveguide arm.

DRAWINGS

Understanding that the drawings depict only exemplary embodiments and are not therefore to be considered limiting in scope, the exemplary embodiments will be described with additional specificity and detail through the use of the accompanying drawings, in which.

DETAILED DESCRIPTION

The present disclosure is directed to example circulators having a stepped floor and/or ceiling along with quarter-wave dielectric transformers. The stepped floor and/or ceiling provides the circulator with a different height in a region proximate a central cavity than the height in a region proximate its waveguide arms. Such a design enables the circulator to have good performance over a wide bandwidth in a reduced size compared to conventional circulators.

Figure 1:
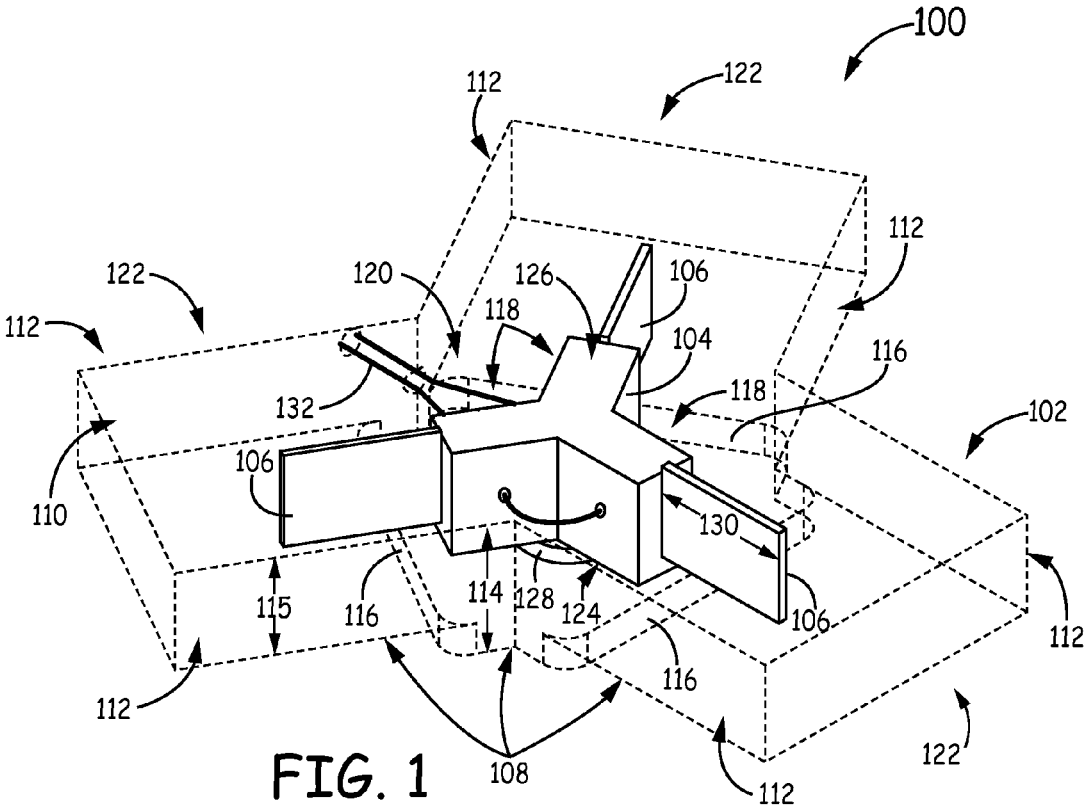
FIG. 1 is an isometric view of an example circulator having a stepped floor along with quarter-wave dielectric transformers, wherein an outline of a hollow interior of a housing of the circulator is shown with dotted lines.
Figure 2:
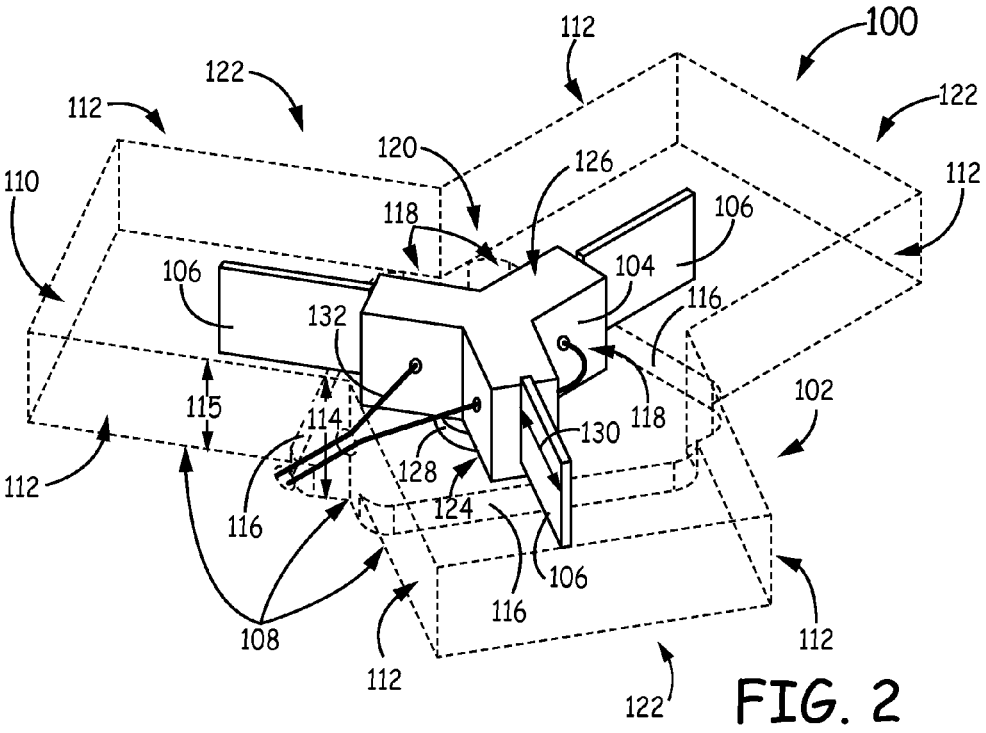
FIG. 2 is another isometric view of the example circulator of FIG. 1.
Figure 3:
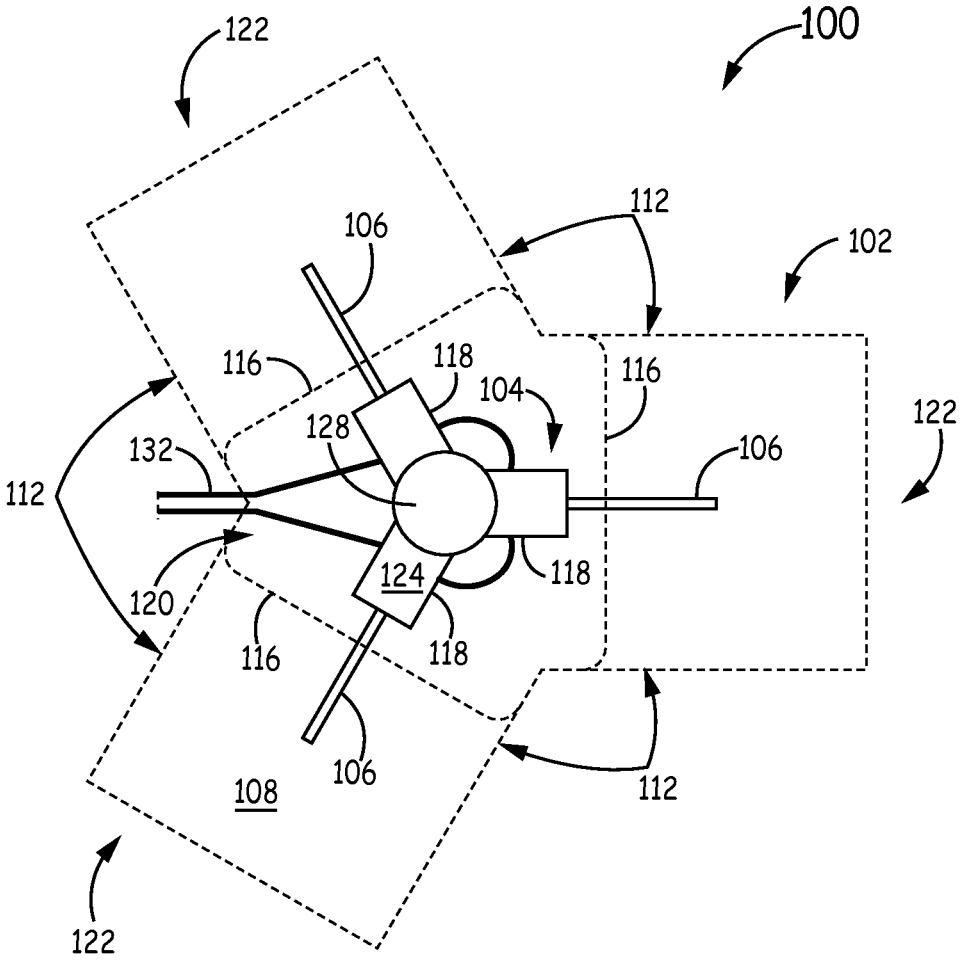
FIG. 3 is a bottom view of the example circulator of FIG. 1.

FIGS. 1 and 2 are isometric views of an example circulator 100 having a stepped floor and/or ceiling along with quarter-wave dielectric transformers. FIG. 3 is a top view of the circulator 100. The circulator 100 includes a waveguide housing 102, ferrite element 104, and one or more quarter-wave transformers 106.

The housing 102 defines a hollow interior that acts as a waveguide and circulator for electromagnetic waves. The housing 102 includes a floor 108, a ceiling 110, a plurality of sidewalls 112, and at least one step 116 which define the hollow interior. The structure of the housing 102 making up the floor 108, ceiling 110, sidewalls 112, and at least one step 116 is not shown in the Figures in order to better view the internal surfaces of the housing 102, as well as the ferrite element 104 and quarter-wave transformers 106 within the housing 102. Instead, the internal surfaces of the housing 102, which define the hollow interior, are illustrated with dotted lines.

In the example shown herein, the housing 102 has six sidewalls 112. The height of the housing 102 at a given location is the distance between the floor 108 and the ceiling 110 at that location. As described in more detail below, the housing 102 includes at least one step 116 in the floor 108 and/or ceiling 110. The at least one step 116 results in the housing 102 having a first height 114 in a first region and a second height 115 in one or more second regions.

The housing 102 can be composed of any suitable electrically conductive material (e.g., metal). In some examples a gas, such as air, is included in the hollow interior. In other examples, the hollow interior can be a vacuum. The hollow interior includes a central cavity 120 that communicates with a plurality of waveguide arms 122. In the example shown herein, the circulator 100 includes three waveguide arms 122. The waveguide arms 122 extend outward from the central cavity 120 and are equi-angularly spaced in a plane around the central cavity 120. Each waveguide arm 122 terminates in a port, which is an open end. In the example having three waveguide arms 122, each waveguide arm 122 is disposed 120 degrees apart from adjacent waveguide arms 122.

The ferrite element 104 is disposed in the central cavity 120 of the housing 102. The ferrite element 104 includes a plurality of arms 118 that extend outward from a central portion of the ferrite element 104. The arms 118 are equi-angularly spaced in a plane around the central portion, and the ferrite element 104 is oriented in the central cavity 120 such that each arm 118 protrudes toward a different waveguide arm 122. In the example shown herein, the ferrite element 104 has three arms 118. The ferrite element 104 is mounted in the central cavity 120 at a bottom surface 124 and/or top surface 126 thereof. The bottom surface 124 and top surface 126 are parallel with the plane in which the arms 118 extend. The bottom surface 124 and/or top surface 126 is mounted to the floor 108 or ceiling 110, respectively. In an example, a dielectric spacer 128 can be included between the bottom surface 124 and/or top surface 126 and the floor 108 or ceiling 110 respectively. In the example shown herein, a dielectric spacer 128 is included between the bottom surface 124 and the floor 108, but no dielectric spacer is included between the top surface 126 and the ceiling 110. In this example, the top surface 126 is not mounted to the ceiling 110 and a gap can be included between the top surface 126 and the ceiling 110 to, for example, provide clearance for the manufacturing tolerances of the housing 102 and ferrite element 104. In other examples, the top surface 126 can be mounted to the ceiling 110 and the bottom surface 124 can be mounted to the floor 108, and dielectric spacers can be included between both the top surface 126 and the ceiling 110 and the bottom surface 124 and the floor 108. In any case, if a dielectric spacer 128 is included (as is shown herein with respect to the bottom surface 124), the surface (e.g., bottom surface 124) of the ferrite element 104 can be attached to one side of the dielectric spacer 128 and the reverse side of the dielectric spacer 128 can be attached to the corresponding surface (e.g., floor 108) of the housing 102. The dielectric spacer(s) 128 can be used to securely position the ferrite element 104 in the housing 102 and to provide a thermal path out of the ferrite element 104 for high power applications. Exemplary materials for the dielectric spacer(s) 128 include boron nitride or beryllium oxide.

A quarter-wave dielectric transformer 106 is respectively attached to a distal end of each arm 118 of the ferrite element 104 and protrudes into a respective waveguide arm 122. In an example, each quarter-wave dielectric transformer 106 is attached to a central location of a distal end of each arm 118 and protrudes into a respective waveguide arm 122 in alignment with the corresponding arm 118. As a quarter-wave transformer 106, the dimension of each quarter-wave dielectric transformer 106 along the direction of propagation is about one quarter of a wavelength of the signal(s) to be coupled by the circulator 100. The direction of propagation is different for each quarter-wave dielectric transformer 106 and corresponds to the waveguide arm 122 in which the respective quarter-wave dielectric transformer 106 is located and the ferrite arm 118 to which the respective quarter-wave dielectric transformer 106 is attached. In particular, the direction of propagation for each quarter-wave dielectric transformer 106 is along (through) the waveguide arms 122 and the arms 118 of the ferrite element 104. Thus, the length 130 of each quarter-wave dielectric transformer 106 is about one quarter of a wavelength of the signal(s) to be coupled. In many examples the circulator 100 is configured to couple signals within a range of frequencies. In such examples, the length 130 of the quarter-wave dielectric transformer 106 is one quarter of a wavelength of a selected frequency (e.g., the center frequency) within such a range of frequencies. In any case, the dimensions of a quarter-wave dielectric transformer 106 are known to those skilled in the art, and any appropriate heights or width for the transformer 106 can be used. In an example, the height (i.e., the dimension extending between the floor 108 and ceiling 110 of the housing 102) of the quarter-wave dielectric transformer 106 is between 25 percent and 98 percent of the height of the housing 104 proximate the transformer 106. That is, each transformer 106 can be separated from the ceiling 110 of the waveguide housing 104 by an air gap. Such a configuration provides clearance for bowing of the housing 104 during assembly of circulator 100, while still providing the desired impedance transformation function.

The quarter-wave dielectric transformers 106 aid in the transition of electromagnetic signals from ferrite element 104 to the air-filled waveguide arms 122. The quarter-wave dielectric transformers 106 can match the lower impedance of ferrite element 104 to that of the air-filled waveguide arms 122 to reduce signal loss. Suitable materials for the quarter-wave dielectric transformers 106 include boron nitride, aluminum nitride, beryllium oxide, as well as ceramics such as forsterite or cordierite.

In examples where the circulator 100 is switchable, a control wire 132, such as a magnetizing winding, can be threaded through an aperture in each arm 118 in order to make ferrite element 110 switchable. In an example where the circulator 100 is not switchable, a control wire 132 may not be used.

In general, waveguide arms 122 convey electromagnetic signals into and out of circulator 100 through ferrite element 104. For example, one of waveguide arms 122 can function as an input arm and one of the other waveguide arms 122 can function as an output arm such that an electromagnetic signal propagates into the circulator 100 through the input arm and is directed out of circulator 100 through the output arm.

As mentioned above, one or both of the floor 108 and ceiling 110 of the housing 102 includes at least one step 116. In the example shown in FIGS. 1, 2, 3, and 4A-4C, the floor 108 includes three steps 116 and the ceiling 110 has no steps. That is, the three steps 116 are each a location in which the floor 108 changes height and the ceiling 110 is a constant height throughout. The steps 116 define a height change in the housing, which defines a junction between a first region having a first height 114 and a second one or more regions having a second height 115. The first region is proximate the central cavity 120 of the housing 102 and the second one or more regions are proximate the waveguide arms 122 of the housing 102. In the example shown in FIGS. 1, 2, and 3, each step 116 is two right angle corners, such that each step 116 results in a sharp height change. In other examples, however, steps 116 can be configured for a more gradual height change. In an implementation where the steps 116 have a gradual height change, each step 116 can be composed of multiple smaller steps. In such an implementation, the length of each smaller step is around or less than the height change of that step. In another implementation where the steps 116 have a gradual height change, each step 116 can comprise a ramp, with the length of the ramp being around or less than the total height change provided by the ramp.

In the example shown in FIGS. 1, 2, and 3, each step 116 is disposed in a respective waveguide arm 122. In particular, each step 116 extends across the respective waveguide arm 122 from a first sidewall 112 to a second sidewall 112 opposite of the first sidewall 112 in the waveguide arm 122. Each step 116 is disposed in the respective waveguide arm 122 close to the central cavity 120 such that the first region includes all of the central cavity 120 and extends slightly into each waveguide arm 122. This step location also results in the second one or more regions including three separate regions, one region in each waveguide arm 122. Each second region includes most (e.g., greater than 80%) of a respective waveguide arm 122.

Figure 4A:
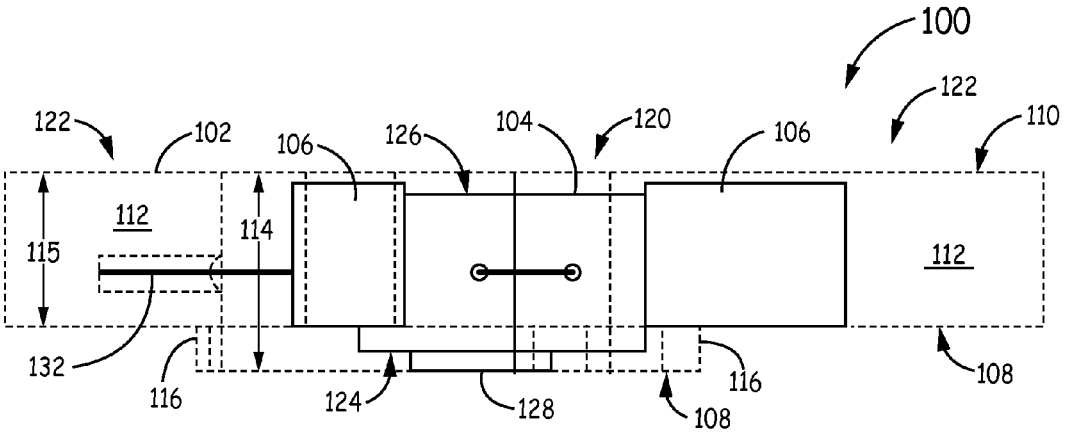
FIGS. 4A-4C are side views of the example circulator of FIG. 1.
Figure 4B:
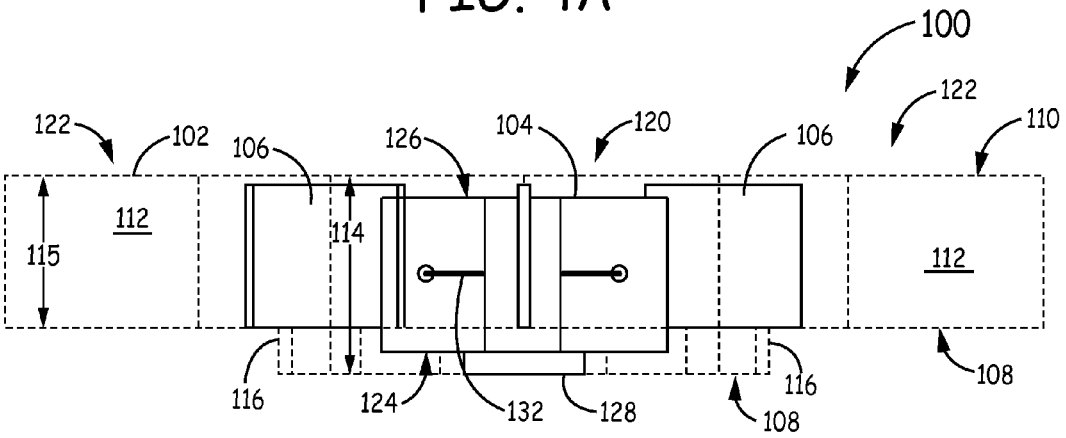
Figure 4C:
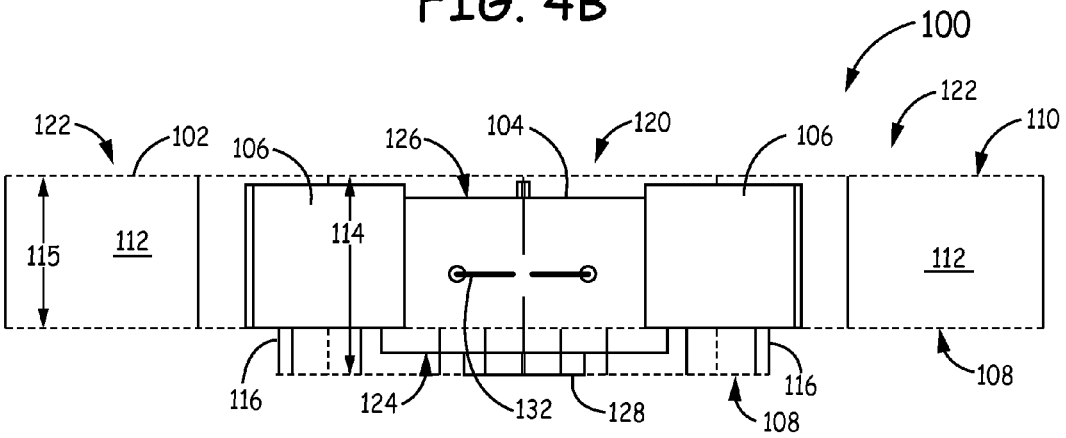

FIGS. 4A-4C are side views of the example circulator 100. As shown, the steps 116 result in the first height 114 for the first region being larger than the second height 115 for the second regions. That is, the region including the central cavity 120 has a larger height than the regions making up most of the waveguide arms 122. This change in height enables the circulator 100 to have good operational characteristics over a wide bandwidth in a reduced size due to the smaller height of the waveguide arms 122. In an example, the first height 114 for the central cavity 120 is selected based on conventional design parameters for the frequency range in which the circulator 100 is to be used. The second height 115 for the waveguide arms 122 is then selected based on size constraints, such as a maximum size for the external dimensions of the waveguide arms 122. The second height 115 is selected to be in the range of 50 to 95 percent of the first height 114. This determines the height of the steps 116. In an example, the second height 115 is 75 percent of the first height 114.

In the example shown in FIGS. 1, 2, and 3, each step 116 is disposed beneath the quarter-wave dielectric transformer 106 that extends into the respective waveguide arm 122. Each quarter-wave dielectric transformer 106 is attached to the floor 108 of the respective waveguide arm 122 in the second region, that is, in the region having the smaller height 115. Each step 116 is disposed beneath a respective quarter-wave dielectric transformer 106 between 5 and 60 percent of the way along the quarter-wave dielectric transformer 106 where 0 percent is the end of the quarter-wave dielectric transformer 106 attached to the ferrite element 104 and 100 percent is the distal end of the quarter-wave dielectric transformer 106 furthest extended into the waveguide arm 122. In this example since each quarter-wave dielectric transformer 106 rests on the top of the corresponding step 116, each step 116 is located no more than 60 percent of the way along the quarter-wave dielectric transformer 106 in order to provide adequate support for the quarter-wave dielectric transformer 106. Additionally, to provide clearance for manufacturing tolerances of the ferrite element 104, each step 116 is designed to be located no less than 5 percent of way along the quarter-wave dielectric transformer 106 to ensure that the step 116 is disposed beneath the quarter-wave dielectric transformer 106 and does not end up beneath the ferrite element 104. In an implementation of this example, each step 116 is located 25 percent of the way along the corresponding quarter-wave dielectric transformer 106.

In the example shown in FIGS. 1-4C only a single step 116 is located in each waveguide arm 122 such that there are only two different heights within the housing 102. Thus, the second regions which are outward from the steps 116 have a constant height from their respective step 116 to the port at the distal end of the waveguide arm 122. Similarly, the first region has a constant height throughout.

The exact location of the steps 116 along the quarter-wave dielectric transformer 106 and the exact height change between the first height 114 and the second height 115 within the ranges listed above can be selected based on the particular operating characteristics (e.g., frequency range) for the circulator 100 among other things.

In the example shown in FIGS. 1-4C, each step 116 is curved near the junction with each respective sidewall 112. The curve extends toward the central cavity 120. In other examples, however, steps 116 may not be curved or may curve in different manners than that shown. Additionally, in the example shown in FIGS. 1-4C, there is no step in the ceiling 110; therefore, the entire height difference between the first height 114 and the second height 115 is accomplished with the steps 116 in the floor 108. In other examples, however, the ceiling 110 and the floor 108 include matching steps, such that the steps in the ceiling 110 are opposite of and align with the steps 116 on the floor 108. In such an example, each step 116 in the floor 108 is disposed within the waveguide arms 122 as described above and a matching step is disposed in the ceiling 110 for each step 116 in the floor 108. Each step 116 in the floor 108 combines with each step in ceiling 110 to result in the height difference between the first height 114 and the second height 115. In an example, the steps 116 in the floor 108 are the same height as the steps in the ceiling 110. In an implementation of such an example, the second height 115 is 75 percent of the first height 114 with the steps 116 in the floor 108 having a height of 12.5 percent of the first height 114 and the steps in the ceiling 110 having a height of 12.5 percent of the first height 114. In any case, the combined height change of the steps 116 in the floor 108 and the steps in the ceiling 110 results in the second height 115 being between 50 and 95 percent of the first height 114.

Figure 5:
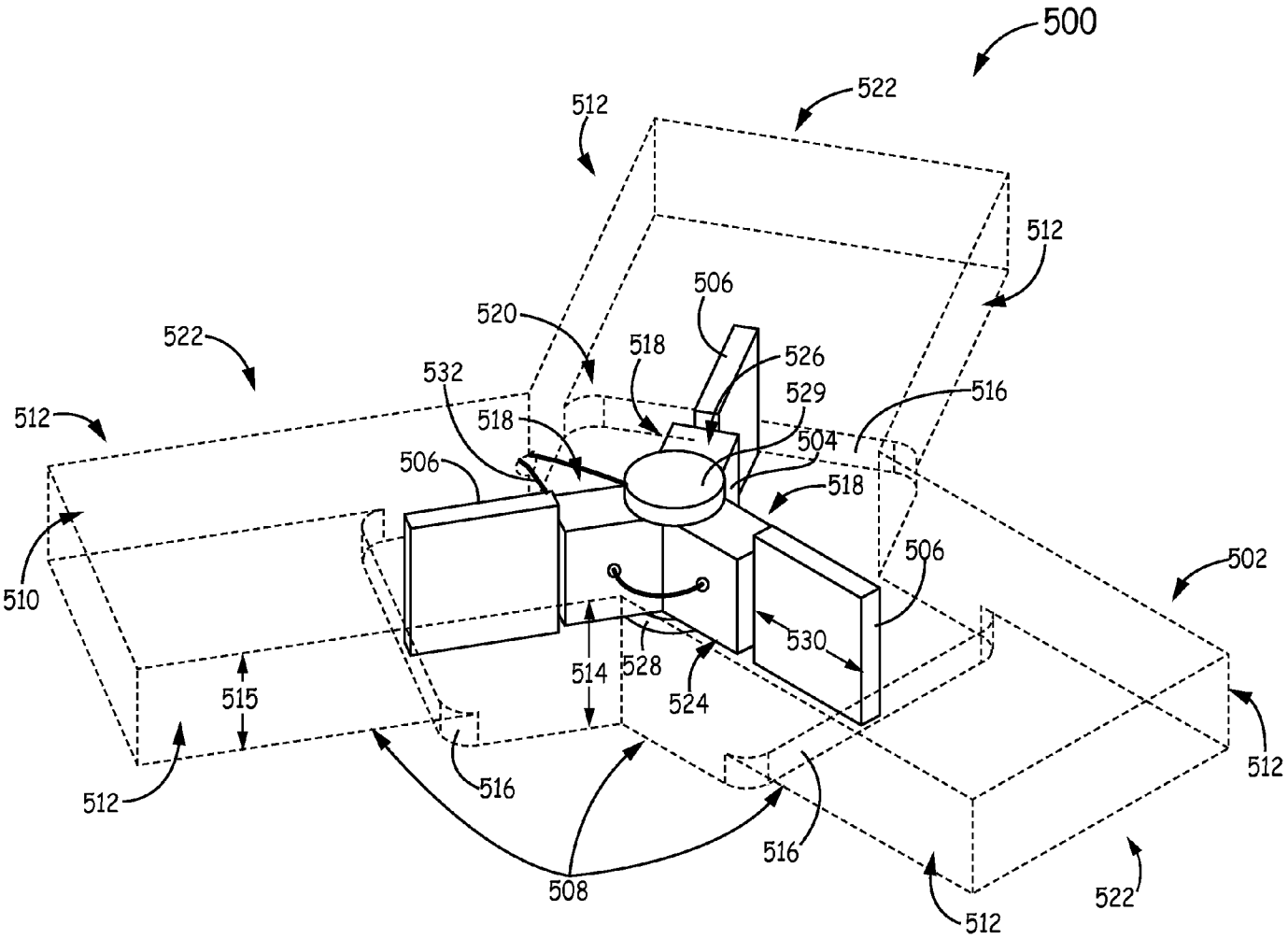
FIG. 5 is an isometric view of another example circulator having a stepped floor along with quarter-wave dielectric transformers, wherein an outline of a hollow interior of a housing of the circulator is shown with dotted lines.
Figure 6:
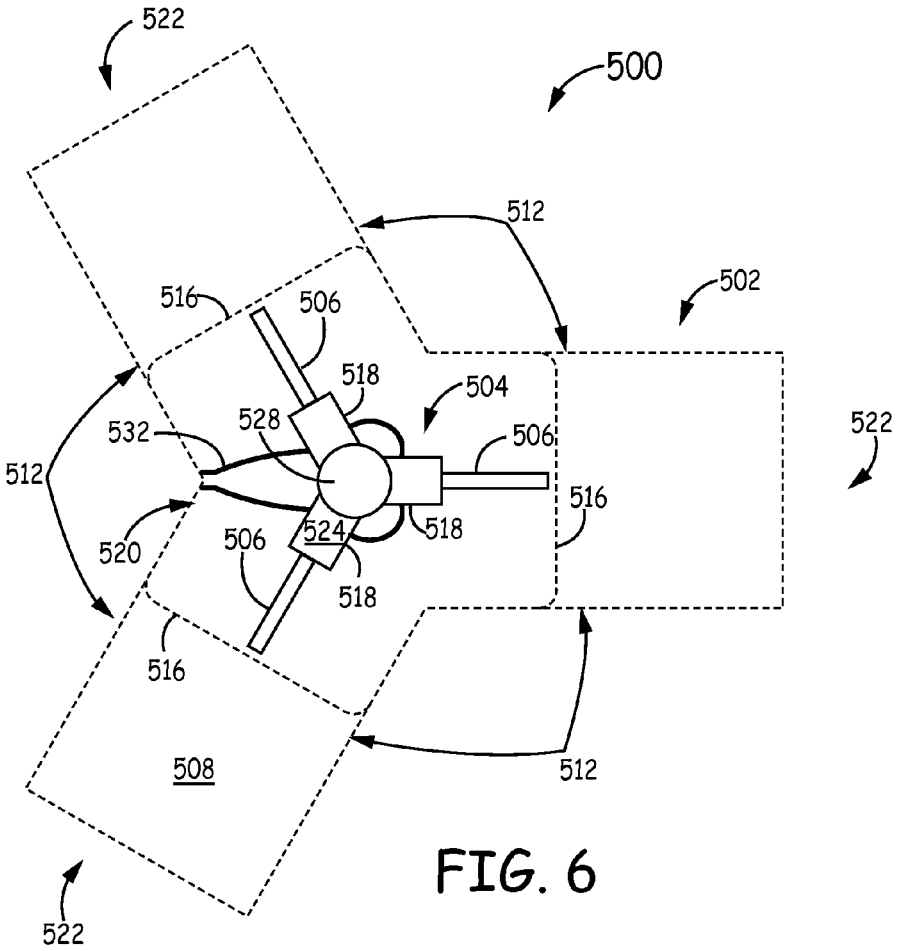
FIG. 6 is a bottom view of the example circulator of FIG. 5.

FIG. 5 is an isometric view of another example circulator 500 having a stepped floor and/or ceiling along with quarter-wave dielectric transformers. FIG. 6 is a top view of the circulator 500. The circulator 500 includes a waveguide housing 502, ferrite element 504, and one or more quarter-wave dielectric transformers 506.

The housing 502 defines a hollow interior that acts as a waveguide and circulator for electromagnetic waves. The housing 502 includes a floor 508, a ceiling 510, a plurality of sidewalls 512, and at least one step 516 which define the hollow interior. The structure of the housing 502 making up the floor 508, ceiling 510, sidewalls 512, and at least one step 516 is not shown in the Figures in order to better view the internal surfaces of the housing 502, as well as the ferrite element 504 and quarter-wave transformers 506 within the housing 502. Instead, the internal surfaces of the housing 502, which define the hollow interior, are illustrated with dotted lines.

In the example shown herein, the housing 502 has six sidewalls 512. The height of the housing 502 at a given location is the distance between the floor 508 and the ceiling 510 at that location. As described in more detail below, the housing 502 includes at least one step 516 in the floor 508 and/or ceiling 510. The at least one step 516 results in the housing 502 having a first height 514 in a first region and a second height 515 in one or more second regions.

The housing 502 can be composed of any suitable electrically conductive material (e.g., metal). In some examples a gas, such as air, is included in the hollow interior. In other examples, the hollow interior can be a vacuum. The hollow interior includes a central cavity 520 that communicates with a plurality of waveguide arms 522. In the example shown herein, the circulator 500 includes three waveguide arms 522. The waveguide arms 522 extend outward from the central cavity 520 and are equi-angularly spaced in a plane around the central cavity 520. Each waveguide arm 522 terminates in a port, which is an open end. In the example having three waveguide arms 522, each waveguide arm 522 is disposed 120 degrees apart from adjacent waveguide arms 522.

The ferrite element 504 is disposed in the central cavity 520 of the housing 502. The ferrite element 504 includes a plurality of arms 518 that extend outward from a central portion of the ferrite element 504. The arms 518 are equi-angularly spaced in a plane around the central portion, and the ferrite element 504 is oriented in the central cavity 520 such that each arm 518 protrudes toward a different waveguide arm 522. In the example shown herein, the ferrite element 504 has three arms 518. The ferrite element 504 is mounted in the central cavity 520 at a bottom surface 524 and/or top surface 526 thereof. The bottom surface 524 and top surface 526 are parallel with the plane in which the arms 518 extend. The bottom surface 524 and/or top surface 526 is mounted to the floor 508 or ceiling 510, respectively. In an example, a dielectric spacer 528, 529 can be included between the bottom surface 524 and/or top surface 526 and the floor 508 or ceiling 510 respectively. In the example shown herein, a first dielectric spacer 528 is included between the bottom surface 524 and the floor 508, and a second dielectric spacer 529 is included between the top surface 526 and the ceiling 510. In this example, the top surface 526 is mounted to the ceiling 510 and the bottom surface 524 is mounted to the floor 508, and dielectric spacers 528, 529 are included between both the top surface 526 and the ceiling 510 and the bottom surface 524 and the floor 508. In other examples, the top surface 526 is not mounted to the ceiling 510, no second dielectric spacer 529 is used, and a gap can be included between the top surface 526 and the ceiling 510 to, for example, provide clearance for the manufacturing tolerances of the housing 502 and ferrite element 504. In any case, if a dielectric spacer 528, 529 is included, the corresponding surface 524, 526 of the ferrite element 504 can be attached to one side of the dielectric spacer 528, 529 and the reverse side of the dielectric spacer 528, 529 can be attached to the corresponding surface (e.g., floor 508, ceiling 110) of the housing 502. The dielectric spacer(s) 528, 529 can be used to securely position the ferrite element 504 in the housing 502 and to provide a thermal path out of the ferrite element 504 for high power applications. Exemplary materials for the dielectric spacer(s) 528, 529 include boron nitride or beryllium oxide.

A quarter-wave dielectric transformer 506 is respectively attached to a distal end of each arm 518 of the ferrite element 504 and protrudes into a respective waveguide arm 522. In an example, each quarter-wave dielectric transformer 506 is attached to a central location of a distal end of each arm 518 and protrudes into a respective waveguide arm 522 in alignment with the corresponding arm 518. As a quarter-wave transformer 506, the dimension of each quarter-wave dielectric transformer 506 along the direction of propagation is about one quarter of a wavelength of the signal(s) to be coupled by the circulator 500. The direction of propagation is different for each quarter-wave dielectric transformer 506 and corresponds to the waveguide arm 522 in which the respective quarter-wave dielectric transformer 506 is located and the ferrite arm 518 to which the respective quarter-wave dielectric transformer 506 is attached. In particular, the direction of propagation for each quarter-wave dielectric transformer 506 is along (through) the corresponding waveguide arm 522 and the corresponding arm 518 of the ferrite element 504. Thus, the length 530 of each quarter-wave dielectric transformer 506 is about one quarter of a wavelength of the signal(s) to be coupled. In many examples the circulator 500 is configured to couple signals within a range of frequencies. In such examples, the length 530 of the quarter-wave dielectric transformer 506 is one quarter of a wavelength of a selected frequency (e.g., the center frequency) within such a range of frequencies. In any case, the dimensions of a quarter-wave dielectric transformer 506 are known to those skilled in the art, and any appropriate heights or width for the transformer 506 can be used. In an example, the height (i.e., the dimension extending between the floor 508 and ceiling 510 of the housing 502) of the quarter-wave dielectric transformer 506 is between 25 percent and 98 percent of the height of the housing 504 proximate the transformer 506. That is, each transformer 506 can be separated from the ceiling 510 of the waveguide housing 504 by an air gap. Such a configuration provides clearance for bowing of the housing 504 during assembly of circulator 500, while still providing the desired impedance transformation function. The quarter-wave dielectric transformers 506 aid in the transition of electromagnetic signals from ferrite element 504 to the air-filled waveguide arms 522. The quarter-wave dielectric transformers 506 can match the lower impedance of ferrite element 504 to that of the air-filled waveguide arms 522 to reduce signal loss. Suitable materials for the quarter-wave dielectric transformers 506 include boron nitride, aluminum nitride, beryllium oxide, as well as ceramics such as forsterite or cordierite.

In examples where the circulator 500 is switchable, a control wire 532, such as a magnetizing winding, can be threaded through an aperture in each arm 518 in order to make ferrite element 510 switchable. In example where the circulator 500 is not switchable, a control wire 532 may not be used.

In general, waveguide arms 522 convey electromagnetic signals into and out of circulator 500 through ferrite element 504. For example, one of waveguide arms 522 can function as an input arm and one of the other waveguide arms 522 can function as an output arm such that an electromagnetic signal propagates into the circulator 500 through the input arm and is directed out of circulator 500 through the output arm.

As mentioned above, one or both of the floor 508 and the ceiling 510 of the housing 502 includes at least one step 516. In the example shown in FIGS. 5, 6, and 7, the floor 508 includes three steps 516 and the ceiling 510 has no steps. That is, the three steps 516 are each a location in which the floor 508 changes height and the ceiling 510 is a constant height throughout. The steps 516 define a height change in the housing 502, which defines a junction between a first region having a first height 514 and a second one or more regions having a second height 515. The first region is proximate the central cavity 520 of the housing 502 and the second one or more regions are proximate the waveguide arms 522 of the housing 502. In the example shown in FIGS. 5, 6, and 7, each step 516 is two right angle corners, such that each step 516 results in a sharp height change. In other examples, however, steps 516 can be configured for a more gradual height change. In an implementation where the steps 516 have a gradual height change, each step 516 can be composed of multiple smaller steps. In such an implementation, the length of each smaller step is around or less than the height change of that step. In another implementation where the steps 516 have a gradual height change, each step 516 can comprise a ramp, with the length of the ramp being around or less than the total height change provided by the ramp.

Figure 7:
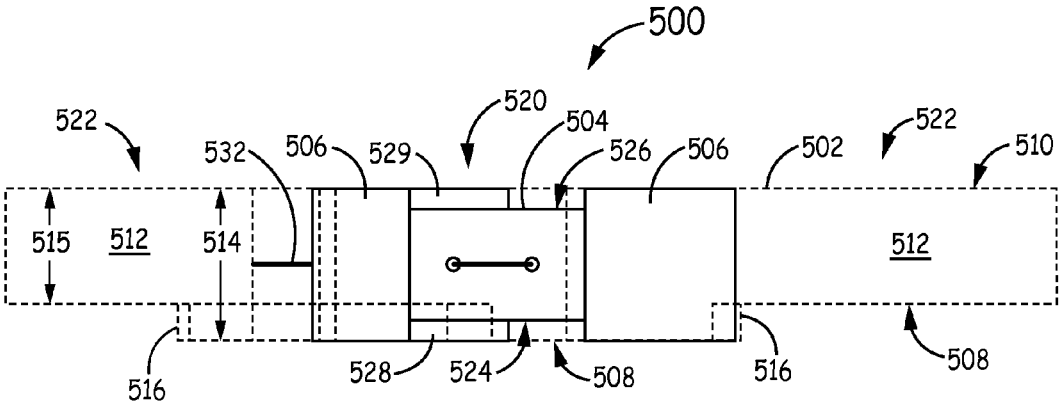
FIG. 7 is a side view of the example circulator of FIG. 5.

In the example shown in FIGS. 5, 6, and 7, each step 516 is disposed in a respective waveguide arm 522. In particular, each step 516 extends across the respective waveguide arm 522 from a first sidewall 512 to a second sidewall 512 opposite of the first sidewall 512. Each step 516 is disposed in the respective waveguide arm 522 outward from the distal end of the corresponding quarter-wave dielectric transformer 506, such that the first region include all of the central cavity 520 and extends part way in each waveguide arm 522. This step location also results in the second one or more regions including three separate regions, one region in each waveguide arm 522. Each second region includes at least half of the respective waveguide arm 522.

FIG. 7 is a side view of the example circulator 500. As shown, the steps 516 result in the first height 514 for the first region being larger than the second height 515 for the second regions. That is, the region including the central cavity 520 has a larger height than the regions making up most of the waveguide arms 522. This change in height enables the circulator 500 to have good operational characteristics over a wide bandwidth in a reduced size due to the smaller height of the waveguide arms 522. In an example, the first height 514 for the central cavity 520 is selected based on conventional design parameters for the frequency range in which the circulator 500 is to be used. The second height 515 for the waveguide arms 522 is then selected based on size constraints, such as a maximum size for the external dimensions of the waveguide arms 522. The second height 515 is selected to be in the range of 50 to 95 percent of the first height 514. This determines the height of the steps 516. In an example, the second height 514 is 75 percent of the first height 514.

In the example shown in FIGS. 5, 6, and 7, each step 516 is disposed outward from the distal end of the quarter-wave dielectric transformer 506 that extends into the respective waveguide arm 522. Each quarter-wave dielectric transformer 506 is attached to the floor 508 of the respective waveguide arm 522 in the first region, that is, in the region having the larger height 514. Each step 516 is disposed outward of a respective quarter-wave dielectric transformer 506 at a distance between 5 and 60 percent of the length 530 of the quarter-wave dielectric transformer 506. That is, the distance between a step 516 and the distal end of the corresponding quarter-wave dielectric transformer 506 is equal to between 5 and 60 percent of the length 530 of the quarter-wave dielectric transformer 506. In an implementation of this example, each step 516 is located away from the distal end of the quarter wave dielectric transformer 506 by a distance equal to 25 percent of the length of the corresponding quarter-wave dielectric transformer 506.

In the example shown in FIGS. 5, 6, and 7, only a single step 516 is located in each waveguide arm 522 such that there are only two different heights within the housing 502. Thus, the second regions which are outward from the steps 516 have a constant height from their respective step 516 to the port at the distal end of the waveguide arm 522. Similarly, the first region has a constant height throughout.

The exact location of the steps 516 outward from the quarter-wave dielectric transformer 506 and the exact height change between the first height 514 and the second height 515 within the ranges listed above can be selected based on the particular operating characteristics (e.g., frequency range) for the circulator 500 among other things.

In the example shown in FIGS. 5, 6, and 7, each step 516 is curved near the junction with each respective sidewall 512. The curve extends toward the central cavity 520. In other examples, however, steps 516 may not be curved or may curve in different manners than that shown. Additionally, in the example shown in FIGS. 5, 6, and 7, there is no step in the ceiling 510; therefore, the entire height difference between the first height 514 and the second height 515 is accomplished with the steps 516 in the floor 508. In other examples, however, the ceiling 510 and the floor 508 include matching steps, such that the steps in the ceiling 510 are opposite of and align with the steps 516 on the floor 508. In such an example, each step 516 in the floor 508 is disposed within the waveguide arms 522 as described above and a matching step is disposed in the ceiling 510 for each step 516 in the floor 508. Each step 516 in the floor 508 combines with each step in ceiling 510 to result in the height difference between the first height 514 and the second height 515. In an example, the steps 516 in the floor 508 are the same height as the steps in the ceiling 510. In an implementation of such an example, the second height 515 is 75 percent of the first height 514 with the steps 516 in the floor 508 having a height of 12.5 percent of the first height 514 and the steps in the ceiling 510 having a height of 12.5 percent of the first height 514. In any case, the combined height change of the steps 516 in the floor 508 and the steps in the ceiling 510 results in the second height 515 being between 50 and 95 percent of the first height 514.

Figure 8:
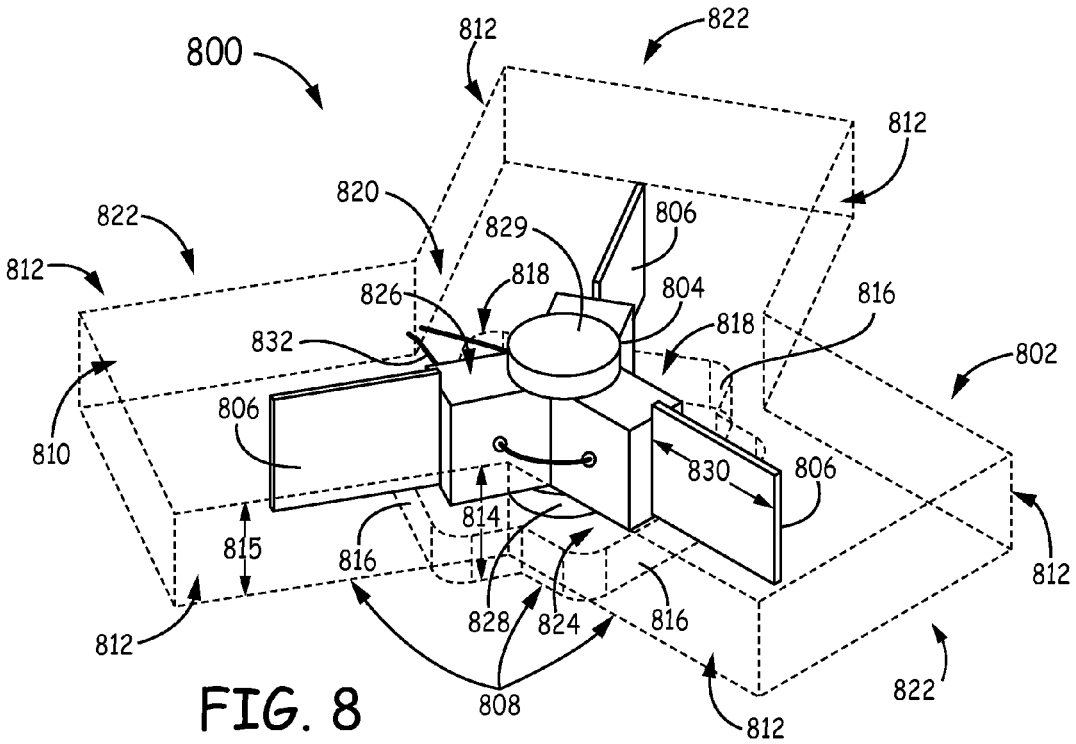
FIG. 8 is an isometric view of yet another example circulator having a stepped floor along with quarter-wave dielectric transformers, wherein an outline of a hollow interior of a housing of the circulator is shown with dotted lines.
Figure 9:
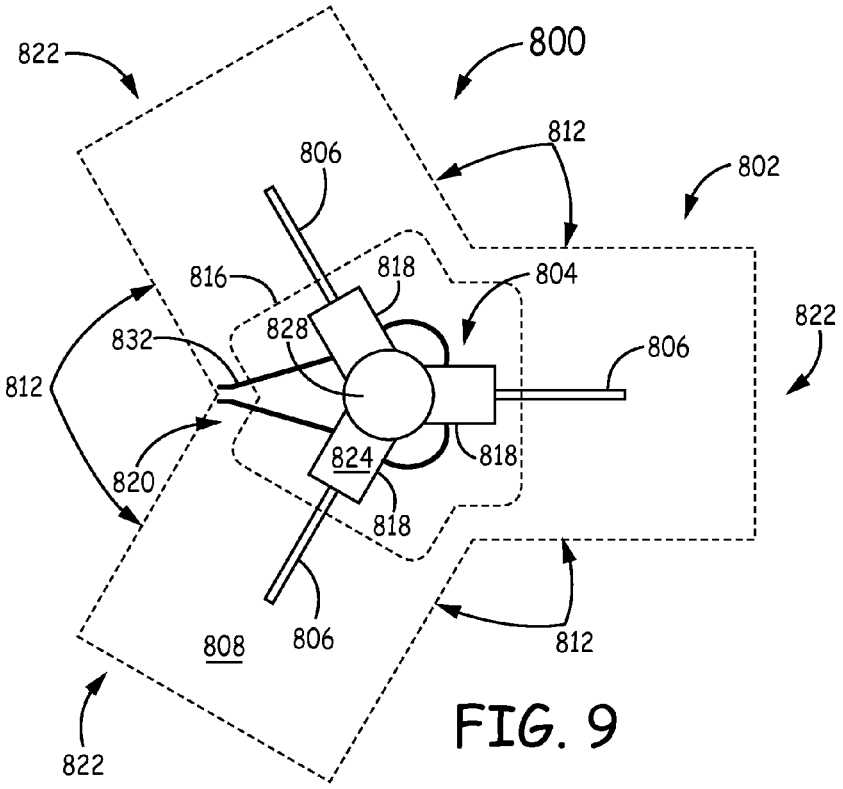
FIG. 9 is a bottom view of the example circulator of FIG. 8.

FIG. 8 is an isometric view of an example circulator 800 having a stepped floor and/or ceiling along with quarter-wave dielectric transformers. FIG. 9 is a top view of the circulator 800. The circulator 800 includes a waveguide housing 802, ferrite element 804, and one or more quarter-wave transformers 806.

The housing 802 defines a hollow interior that acts as a waveguide and circulator for electromagnetic waves. The housing 802 includes a floor 808, a ceiling 810, a plurality of sidewalls 812, and at least one step 816 which define the hollow interior. The structure of the housing 802 making up the floor 808, ceiling 810, sidewalls 812, and at least one step 816 is not shown in the Figures in order to better view the internal surfaces of the housing 802, as well as the ferrite element 804 and quarter-wave transformers 806 within the housing 802. Instead, the internal surfaces of the housing 802, which define the hollow interior, are illustrated with dotted lines.

In the example shown herein, the housing 802 has six sidewalls 812. The height of the housing 802 at a given location is the distance between the floor 808 and the ceiling 810 at that location. As described in more detail below, the housing 802 includes at least one step 816 in the floor 808 and/or ceiling 810. The at least one step 816 results in the housing 802 having a first height 814 in a first region and a second height 815 in one or more second regions.

The housing 802 can be composed of any suitable electrically conductive material (e.g., metal). In some examples a gas, such as air, is included in the hollow interior. In other examples, the hollow interior can be a vacuum. The hollow interior includes a central cavity 820 that communicates with a plurality of waveguide arms 822. In the example shown herein, the circulator 800 includes three waveguide arms 822. The waveguide arms 822 extend outward from the central cavity 820 and are equi-angularly spaced in a plane around the central cavity 820. Each waveguide arm 822 terminates in a port, which is an open end. In the example having three waveguide arms 822, each waveguide arm 822 is disposed 120 degrees apart from adjacent waveguide arms 822.

The ferrite element 804 is disposed in the central cavity 820 of the housing 802. The ferrite element 804 includes a plurality of arms 818 that extend outward from a central portion of the ferrite element 804. The arms 818 are equi-angularly spaced in a plane around the central portion, and the ferrite element 804 is oriented in the central cavity 820 such that each arm 818 protrudes toward a different waveguide arm 822. In the example shown herein, the ferrite element 804 has three arms 818. The ferrite element 804 is mounted in the central cavity 820 at a bottom surface 824 and/or top surface 826 thereof. The bottom surface 824 and top surface 826 are parallel with the plane in which the arms 818 extend. The bottom surface 824 and/or top surface 826 is mounted to the floor 808 or ceiling 810, respectively. In an example, a dielectric spacer 828, 829 can be included between the bottom surface 824 and/or top surface 826 and the floor 808 or ceiling 810 respectively. In the example shown herein, a first dielectric spacer 828 is included between the bottom surface 824 and the floor 808, and a second dielectric spacer 829 is included between the top surface 826 and the ceiling 810. In this example, the top surface 826 is mounted to the ceiling 810 and the bottom surface 824 is mounted to the floor 808, and dielectric spacers 828, 829 are included between both the top surface 826 and the ceiling 810 and the bottom surface 824 and the floor 808. In other examples, the top surface 826 is not mounted to the ceiling 810, no second dielectric spacer 829 is used, and a gap can be included between the top surface 826 and the ceiling 810 to, for example, provide clearance for the manufacturing tolerances of the housing 802 and ferrite element 804. In any case, if a dielectric spacer 828, 829 is included, the corresponding surface 824, 826 of the ferrite element 804 can be attached to one side of the dielectric spacer 828, 829 and the reverse side of the dielectric spacer 828, 829 can be attached to the corresponding surface (e.g., floor 808, ceiling 810) of the housing 802. The dielectric spacer(s) 828, 829 can be used to securely position the ferrite element 804 in the housing 802 and to provide a thermal path out of the ferrite element 804 for high power applications. Exemplary materials for the dielectric spacer(s) 828, 829 include boron nitride or beryllium oxide.

A quarter-wave dielectric transformer 806 is respectively attached to a distal end of each arm 818 of the ferrite element 804 and protrudes into a respective waveguide arm 822. In an example, each quarter-wave dielectric transformer 806 is attached to a central location of a distal end of each arm 818 and protrudes into a respective waveguide arm 822 in alignment with the corresponding arm 818. As a quarter-wave transformer 806, the dimension of each quarter-wave dielectric transformer 806 along the direction of propagation is about one quarter of a wavelength of the signal(s) to be coupled by the circulator 800. The direction of propagation is different for each quarter-wave dielectric transformer 806 and corresponds to the waveguide arm 822 in which the respective quarter-wave dielectric transformer 806 is located and the ferrite arm 818 to which the respective quarter-wave dielectric transformer 806 is attached. In particular, the direction of propagation for each quarter-wave dielectric transformer 806 is along (through) the waveguide arms 822 and the arms 818 of the ferrite element 804. Thus, the length 830 of each quarter-wave dielectric transformer 806 is about one quarter of a wavelength of the signal(s) to be coupled. In many examples the circulator 800 is configured to couple signals within a range of frequencies. In such examples, the length 830 of the quarter-wave dielectric transformer 806 is one quarter of a wavelength of a selected frequency (e.g., the center frequency) within such a range of frequencies. In any case, the dimensions of a quarter-wave dielectric transformer 806 are known to those skilled in the art, and any appropriate heights or width for the transformer 806 can be used. In an example, the height (i.e., the dimension extending between the floor 808 and ceiling 810 of the housing 802) of the quarter-wave dielectric transformer 806 is between 25 percent and 98 percent of the height of the housing 804 proximate the transformer 806. That is, each transformer 806 can be separated from the ceiling 810 of the waveguide housing 804 by an air gap. Such a configuration provides clearance for bowing of the housing 804 during assembly of circulator 800, while still providing the desired impedance transformation function.

The quarter-wave dielectric transformers 806 aid in the transition of electromagnetic signals from ferrite element 804 to the air-filled waveguide arms 822. The quarter-wave dielectric transformers 806 can match the lower impedance of ferrite element 804 to that of the air-filled waveguide arms 822 to reduce signal loss. Suitable materials for the quarter-wave dielectric transformers 806 include boron nitride, aluminum nitride, beryllium oxide, as well as ceramics such as forsterite or cordierite.

In examples where the circulator 800 is switchable, a control wire 832, such as a magnetizing winding, can be threaded through an aperture in each arm 818 in order to make ferrite element 810 switchable. In example where the circulator 800 is not switchable, a control wire 832 may not be used.

In general, waveguide arms 822 convey electromagnetic signals into and out of circulator 800 through ferrite element 804. For example, one of waveguide arms 822 can function as an input arm and one of the other waveguide arms 822 can function as an output arm such that an electromagnetic signal propagates into the circulator 800 through the input arm and is directed out of circulator 800 through the output arm.

As mentioned above, one or both of the floor 808 and ceiling 810 of the housing 802 includes at least one step 816. In the example shown in FIGS. 8 and 9, the floor 808 includes one step 816 and the ceiling 810 has no steps. That is, the step 816 is a location in which the floor 808 changes height and the ceiling 810 is a constant height throughout. The step 816 defines a height change in the housing, which defines a junction between a first region having a first height 814 and a second one or more regions having a second height 815. The first region is proximate the central cavity 820 of the housing 802 and the second one or more regions are proximate the waveguide arms 822 of the housing 802. In the example shown in FIGS. 8 and 9, the step 816 is two right angle corners, such that the step 816 results in a sharp height change. In other examples, however, the step 816 can be configured for a more gradual height change. In an implementation where the step 816 has a gradual height change, the step 816 can be composed of multiple smaller steps. In such an implementation, the length of each smaller step is around or less than the height change of that step. In another implementation where the step 816 has a gradual height change, the step 816 can comprise a ramp, with the length of the ramp being around or less than the total height change provided by the ramp.

In the example shown in FIGS. 8 and 9, the step 816 is disposed in closed loop around the ferrite element 804. The step 816 extends partially across each waveguide arm 822, but does not extend to either sidewall 812 of each waveguide arm 822. Instead, the step 816 includes a bend near each sidewall 812 to progress to the adjacent waveguide arms 822 and extend partially across them. The step 816 does this for each waveguide arm 822 to form the closed loop. In this example, the portions of the step 816 that extend partially across each waveguide arm 822 are disposed in the respective waveguide arm 822 close to the central cavity 820 such that the first region includes at least half of the central cavity 820 and extends slightly into each waveguide arm 822. This step location also results in the second one or more regions including one region that includes most (e.g., greater than 80%) of each waveguide arm 822. In an example, the portions of the step 816 that extend partially across each waveguide arm 822 extend from 20 to 95 percent of the way across the respective waveguide arm 822.

As shown, the step 816 results in the first height 814 for the first region being larger than the second height 815 for the second region. That is, the region including most of the central cavity 820 has a larger height than the region making up most of the waveguide arms 822. This change in height enables the circulator 800 to have good operational characteristics over a wide bandwidth in a reduced size due to the smaller height of the waveguide arms 822. In an example, the first height 814 for the central cavity 820 is selected based on conventional design parameters for the frequency range in which the circulator 800 is to be used. The second height 815 for the waveguide arms 822 is then selected based on size constraints, such as a maximum size for the external dimensions of the waveguide arms 822. The second height 815 is selected to be in the range of 50 to 95 percent of the first height 814. This determines the height of the step 816. In an example, the second height 815 is 75 percent of the first height 814.

In the example shown in FIGS. 8 and 9, a portion of the step 816 is disposed beneath the quarter-wave dielectric transformer 806 that extends into the respective waveguide arm 822. Each quarter-wave dielectric transformer 806 is attached to the floor 808 of the respective waveguide arm 822 in the second region, that is, in the region having the smaller height 815. The portion of the step 816 disposed beneath a respective quarter-wave dielectric transformer 806 is disposed between 5 and 60 percent of the way along the quarter-wave dielectric transformer 806 where 0 percent is the end of the quarter-wave dielectric transformer 806 attached to the ferrite element 804 and 100 percent is the distal end of the quarter-wave dielectric transformer 806 furthest extended into the waveguide arm 822. In this example since each quarter-wave dielectric transformer 806 rests on the top of the step 816, the corresponding portion of the step 816 is located no more than 60 percent of the way along the quarter-wave dielectric transformer 806 in order to provide adequate support for the quarter-wave dielectric transformer 806. Additionally, to provide clearance for manufacturing tolerances of the ferrite element 804, the step 816 is designed to be located no less than 5 percent of way along the quarter-wave dielectric transformer 806 to ensure that the step 816 is disposed beneath the quarter-wave dielectric transformer 806 and does not end up beneath the ferrite element 804. In an implementation of this example, the corresponding portion of the step 816 is located 25 percent of the way along the corresponding quarter-wave dielectric transformer 806.

In the example shown in FIGS. 8 and 9 the housing 802 includes only a single step 816 such that there are only two different heights within the housing 802. Thus, the second region which is outward from the step 816 has a constant height from the step 816 to the port at the distal end of the waveguide arm 822. Similarly, the first region has a constant height throughout.

The exact location of the step 816 along the quarter-wave dielectric transformers 806 and the exact height change between the first height 814 and the second height 815 within the ranges listed above can be selected based on the particular operating characteristics (e.g., frequency range) for the circulator 800 among other things.

In the example shown in FIGS. 8 and 9, there is no step in the ceiling 810; therefore, the entire height difference between the first height 814 and the second height 815 is accomplished with the step 816 in the floor 808. In other examples, however, the ceiling 810 and the floor 808 include matching steps, such that the step in the ceiling 810 is opposite of and aligns with the step 816 on the floor 808. In such an example, the step 816 in the floor 808 is disposed in the closed loop as described above and a matching step is disposed in a closed loop in the ceiling 810. The step 816 in the floor 808 combines with the step in ceiling 810 to result in the height difference between the first height 814 and the second height 815. In an example, the step 816 in the floor 808 is the same height as the step in the ceiling 810. In an implementation of such an example, the second height 815 is 75 percent of the first height 814 with the step 816 in the floor 808 having a height of 12.5 percent of the first height 814 and the step in the ceiling 810 having a height of 12.5 percent of the first height 814. In any case, the combined height change of the step 816 in the floor 808 and the step in the ceiling 810 results in the second height 815 being between 50 and 95 percent of the first height 814.

Figure 10:
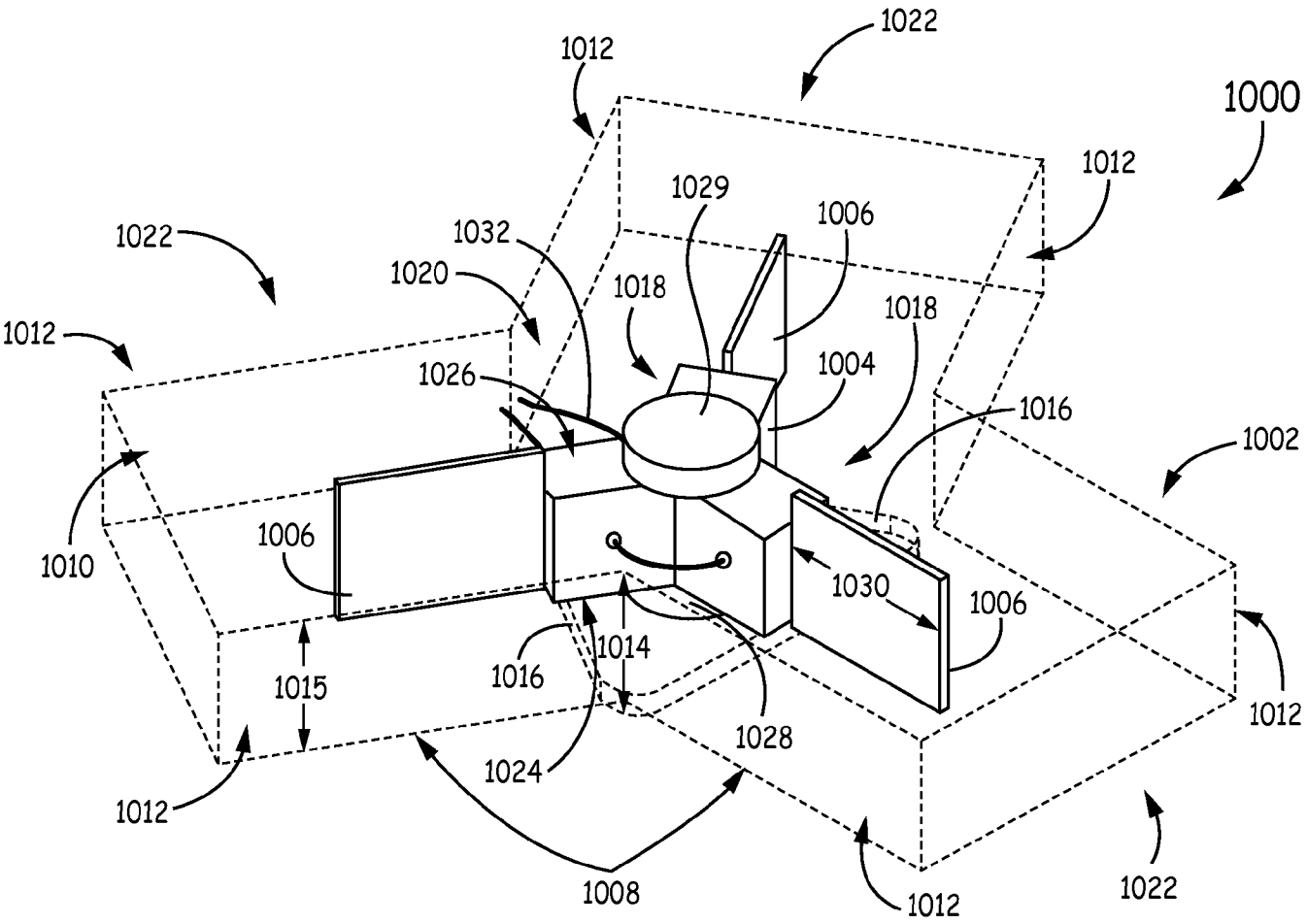
FIG. 10 is an isometric view of still another example circulator having a stepped floor along with quarter-wave dielectric transformers, wherein an outline of a hollow interior of a housing of the circulator is shown with dotted lines.
Figure 11:
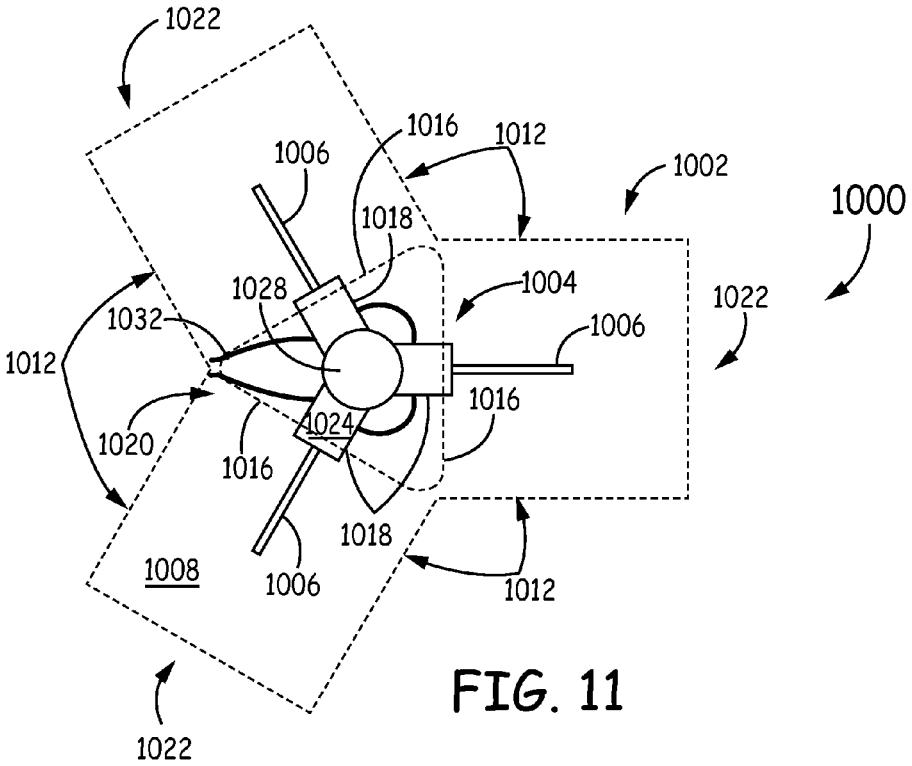
FIG. 11 is a bottom view of the example circulator of FIG. 10.

FIG. 10 is an isometric view of an example circulator 1000 having a stepped floor and/or ceiling along with quarter-wave dielectric transformers. FIG. 11 is a top view of the circulator 1000. The circulator 1000 includes a waveguide housing 1002, ferrite element 1004, and one or more quarter-wave transformers 1006.

The housing 1002 defines a hollow interior that acts as a waveguide and circulator for electromagnetic waves. The housing 1002 includes a floor 1008, a ceiling 1010, a plurality of sidewalls 1012, and at least one step 1016 which define the hollow interior. The structure of the housing 1002 making up the floor 1008, ceiling 1010, sidewalls 1012, and at least one step 1016 is not shown in the Figures in order to better view the internal surfaces of the housing 1002, as well as the ferrite element 1004 and quarter-wave transformers 1006 within the housing 1002. Instead, the internal surfaces of the housing 1002, which define the hollow interior, are illustrated with dotted lines.

In the example shown herein, the housing 1002 has six sidewalls 1012. The height of the housing 1002 at a given location is the distance between the floor 1008 and the ceiling 1010 at that location. As described in more detail below, the housing 1002 includes at least one step 1016 in the floor 1008 and/or ceiling 1010. The at least one step 1016 results in the housing 1002 having a first height 1014 in a first region and a second height 1015 in one or more second regions.

The housing 1002 can be composed of any suitable electrically conductive material (e.g., metal). In some examples a gas, such as air, is included in the hollow interior. In other examples, the hollow interior can be a vacuum. The hollow interior includes a central cavity 1020 that communicates with a plurality of waveguide arms 1022. In the example shown herein, the circulator 1000 includes three waveguide arms 1022. The waveguide arms 1022 extend outward from the central cavity 1020 and are equi-angularly spaced in a plane around the central cavity 1020. Each waveguide arm 1022 terminates in a port, which is an open end. In the example having three waveguide arms 1022, each waveguide arm 1022 is disposed 120 degrees apart from adjacent waveguide arms 1022.

The ferrite element 1004 is disposed in the central cavity 1020 of the housing 1002. The ferrite element 1004 includes a plurality of arms 1018 that extend outward from a central portion of the ferrite element 1004. The arms 1018 are equi-angularly spaced in a plane around the central portion, and the ferrite element 1004 is oriented in the central cavity 1020 such that each arm 1018 protrudes toward a different waveguide arm 1022. In the example shown herein, the ferrite element 1004 has three arms 1018. The ferrite element 1004 is mounted in the central cavity 1020 at a bottom surface 1024 and/or top surface 1026 thereof. The bottom surface 1024 and top surface 1026 are parallel with the plane in which the arms 1018 extend. The bottom surface 1024 and/or top surface 1026 is mounted to the floor 1008 or ceiling 1010, respectively. In an example, a dielectric spacer 1028, 1029 can be included between the bottom surface 1024 and/or top surface 1026 and the floor 1008 or ceiling 1010 respectively. In the example shown herein, a first dielectric spacer 1028 is included between the bottom surface 1024 and the floor 1008, and a second dielectric spacer 1029 is included between the top surface 1026 and the ceiling 1010. In this example, the top surface 1026 is mounted to the ceiling 1010 and the bottom surface 1024 is mounted to the floor 1008, and dielectric spacers 1028, 1029 are included between both the top surface 1026 and the ceiling 1010 and the bottom surface 1024 and the floor 1008. In other examples, the top surface 1026 is not mounted to the ceiling 1010, no second dielectric spacer 1029 is used, and a gap can be included between the top surface 1026 and the ceiling 1010 to, for example, provide clearance for the manufacturing tolerances of the housing 1002 and ferrite element 1004. In any case, if a dielectric spacer 1028, 1029 is included, the corresponding surface 1024, 1026 of the ferrite element 1004 can be attached to one side of the dielectric spacer 1028, 1029 and the reverse side of the dielectric spacer 1028, 1029 can be attached to the corresponding surface (e.g., floor 1008, ceiling 1010) of the housing 1002. The dielectric spacer(s) 1028, 1029 can be used to securely position the ferrite element 1004 in the housing 1002 and to provide a thermal path out of the ferrite element 1004 for high power applications. Exemplary materials for the dielectric spacer(s) 1028, 1029 include boron nitride or beryllium oxide.

A quarter-wave dielectric transformer 1006 is respectively attached to a distal end of each arm 1018 of the ferrite element 1004 and protrudes into a respective waveguide arm 1022. In an example, each quarter-wave dielectric transformer 1006 is attached to a central location of a distal end of each arm 1018 and protrudes into a respective waveguide arm 1022 in alignment with the corresponding arm 1018. As a quarter-wave transformer 1006, the dimension of each quarter-wave dielectric transformer 1006 along the direction of propagation is about one quarter of a wavelength of the signal(s) to be coupled by the circulator 1000. The direction of propagation is different for each quarter-wave dielectric transformer 1006 and corresponds to the waveguide arm 1022 in which the respective quarter-wave dielectric transformer 1006 is located and the ferrite arm 1018 to which the respective quarter-wave dielectric transformer 1006 is attached. In particular, the direction of propagation for each quarter-wave dielectric transformer 1006 is along (through) the waveguide arms 1022 and the arms 1018 of the ferrite element 1004. Thus, the length 1030 of each quarter-wave dielectric transformer 1006 is about one quarter of a wavelength of the signal(s) to be coupled. In many examples the circulator 1000 is configured to couple signals within a range of frequencies. In such examples, the length 1030 of the quarter-wave dielectric transformer 1006 is one quarter of a wavelength of a selected frequency (e.g., the center frequency) within such a range of frequencies. In any case, the dimensions of a quarter-wave dielectric transformer 1006 are known to those skilled in the art, and any appropriate heights or width for the transformer 1006 can be used. In an example, the height (i.e., the dimension extending between the floor 1008 and ceiling 1010 of the housing 1002) of the quarter-wave dielectric transformer 1006 is between 25 percent and 98 percent of the height of the housing 1004 proximate the transformer 1006. That is, each transformer 1006 can be separated from the ceiling 1010 of the waveguide housing 1004 by an air gap. Such a configuration provides clearance for bowing of the housing 1004 during assembly of circulator 1000, while still providing the desired impedance transformation function.

The quarter-wave dielectric transformers 1006 aid in the transition of electromagnetic signals from ferrite element 1004 to the air-filled waveguide arms 1022. The quarter-wave dielectric transformers 1006 can match the lower impedance of ferrite element 1004 to that of the air-filled waveguide arms 1022 to reduce signal loss. Suitable materials for the quarter-wave dielectric transformers 1006 include boron nitride, aluminum nitride, beryllium oxide, as well as ceramics such as forsterite or cordierite.

In examples where the circulator 1000 is switchable, a control wire 1032, such as a magnetizing winding, can be threaded through an aperture in each arm 1018 in order to make ferrite element 1010 switchable. In example where the circulator 1000 is not switchable, a control wire 1032 may not be used.

In general, waveguide arms 1022 convey electromagnetic signals into and out of circulator 1000 through ferrite element 1004. For example, one of waveguide arms 1022 can function as an input arm and one of the other waveguide arms 1022 can function as an output arm such that an electromagnetic signal propagates into the circulator 1000 through the input arm and is directed out of circulator 1000 through the output arm.

As mentioned above, one or both of the floor 1008 and ceiling 1010 of the housing 1002 includes at least one step 1016. In the example shown in FIGS. 10 and 11, the floor 1008 includes one step 1016 and the ceiling 1010 has no steps. That is, the step 1016 is a location in which the floor 1008 changes height and the ceiling 1010 is a constant height throughout. The step 1016 defines a height change in the housing, which defines a junction between a first region having a first height 1014 and a second one or more regions having a second height 1015. The first region is proximate the central cavity 1020 of the housing 1002 and the second one or more regions are proximate the waveguide arms 1022 of the housing 1002. In the example shown in FIGS. 10 and 11, the step 1016 is two right angle corners, such that the step 1016 results in a sharp height change. In other examples, however, the step 1016 can be configured for a more gradual height change. In an implementation where the step 1016 has a gradual height change, the step 1016 can be composed of multiple smaller steps. In such an implementation, the length of each smaller step is around or less than the height change of that step. In another implementation where the step 1016 has a gradual height change, each the 116 can comprise a ramp, with the length of the ramp being around or less than the total height change provided by the ramp.

In the example shown in FIGS. 10 and 11, the step 1016 is disposed in closed loop around a center of the central cavity 1020 and underneath the ferrite element 1004. The step 1016 extends underneath each arm 1018 of the ferrite element 1004 and forms a triangular shape in a closed loop. The step 1016 does this for each waveguide arm 1022 to form the closed loop. In this example, the portions of the step 1016 that extend underneath each arm 1018 are disposed near the distal end of each 1018 such that the first region includes at least most of the central cavity 1020. This step location results in the second region(s) including at least most of each waveguide arm 1022. In the example shown in FIGS. 10 and 11, the step 1016 does not meet with the sidewalls 1012. In other examples, the step 1016 can meet with the sidewalls 1012 and the apexes of the triangle.

Figure 12:
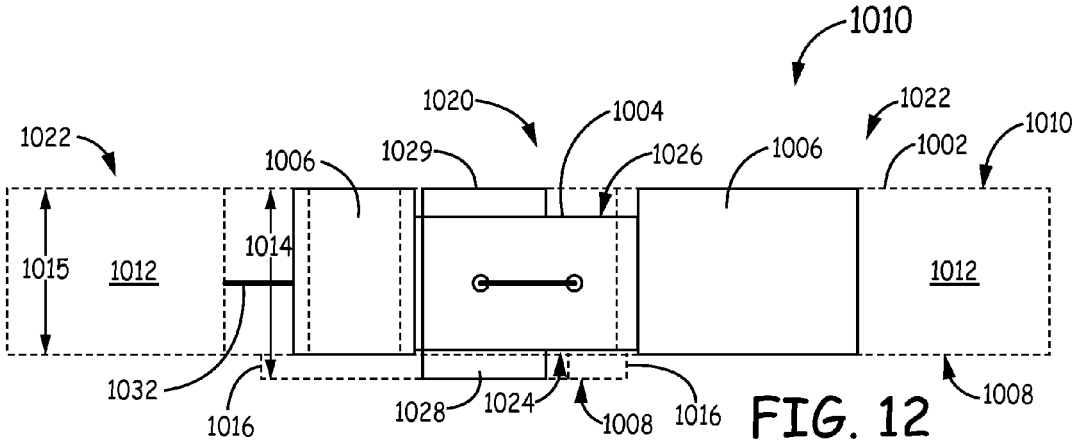
FIG. 12 is a side view of the example circulator of FIG. 10.

FIG. 12 is a side view of the example circulator 1000. As shown, the step 1016 results in the first height 1014 for the first region being larger than the second height 1015 for the second region. That is, the region including the central cavity 1020 has a larger height than the region making up the waveguide arms 1022. This change in height enables the circulator 1000 to have good operational characteristics over a wide bandwidth in a reduced size due to the smaller height of the waveguide arms 1022. In an example, the first height 1014 for the central cavity 1020 is selected based on conventional design parameters for the frequency range in which the circulator 1000 is to be used. The second height 1015 for the waveguide arms 1022 is then selected based on size constraints, such as a maximum size for the external dimensions of the waveguide arms 1022. The second height 1015 is selected to be in the range of 50 to 95 percent of the first height 1014. This determines the height of the step 1016. In an example, the second height 1015 is 75 percent of the first height 1014.

In the example shown in FIGS. 10-12, a portion of the step 1016 is disposed beneath each arm 1018 of the ferrite element 104. Each quarter-wave dielectric transformer 1006 is attached to the floor 1008 of the respective waveguide arm 1022 in the second region, that is, in the region having the smaller height 1015. In the example shown in FIGS. 10-12 the housing 1002 includes only a single step 1016 such that there are only two different heights within the housing 1002. Thus, the second region which is outward from the step 1016 has a constant height from the step 1016 to the port at the distal end of the waveguide arm 1022. Similarly, the first region has a constant height throughout.

The exact location of the step 1016 and the exact height change between the first height 1014 and the second height 1015 within the ranges listed above can be selected based on the particular operating characteristics (e.g., frequency range) for the circulator 1000 among other things.

In the example shown in FIGS. 10-12, there is no step in the ceiling 1010; therefore, the entire height difference between the first height 1014 and the second height 1015 is accomplished with the step 1016 in the floor 1008. In other examples, however, the ceiling 1010 and the floor 1008 include matching steps, such that the step in the ceiling 1010 is opposite of and aligns with the step 1016 on the floor 1008. In such an example, the step 1016 in the floor 1008 is disposed in the closed loop as described above and a matching step is disposed in a closed loop in the ceiling 1010. The step 1016 in the floor 1008 combines with the step in ceiling 1010 to result in the height difference between the first height 1014 and the second height 1015. In an example, the step 1016 in the floor 1008 is the same height as the step in the ceiling 1010. In an implementation of such an example, the second height 1015 is 75 percent of the first height 1014 with the step 1016 in the floor 1008 having a height of 12.5 percent of the first height 1014 and the step in the ceiling 1010 having a height of 12.5 percent of the first height 1014. In any case, the combined height change of the step 1016 in the floor 1008 and the step in the ceiling 1010 results in the second height 1015 being between 50 and 95 percent of the first height 1014.

EXAMPLE EMBODIMENTS

Example 1 includes a circulator comprising: a waveguide housing having a plurality of hollow waveguide arms that communicate with a central cavity, wherein the waveguide arms include, and the central cavity is defined by, a floor, a ceiling, and a plurality of sidewalls connected between the floor and the ceiling, wherein at least one of the floor or the ceiling includes at least one step which defines a junction between a first region having a first height between the floor and the ceiling and one or more second regions having a second height between the floor and the ceiling, the first region proximate the central cavity and the one or more second regions proximate the waveguide arms, wherein the first height is larger than the second height; a ferrite element disposed in the central cavity of the waveguide housing, the ferrite element including a plurality of arms corresponding to the plurality of hollow waveguide arms; and one or more quarter-wave dielectric transformers attached to the ferrite element, each quarter-wave dielectric transformer protruding from a respective arm of the ferrite element into a respective waveguide arm.

Example 2 includes the circulator of Example 1, wherein the second height is between 50 and 95 percent of the first height.

Example 3 includes the circulator of any of Examples 1-2, wherein the at least one step includes a plurality of steps in the floor or the ceiling respectively, each step extending across a respective waveguide arm from a first sidewall of the respective waveguide arm to a second sidewall of the respective waveguide arm, the second sidewall opposite the first sidewall, each step extending such that the first region includes all of the central cavity and the one or more second regions include a region in each waveguide arm respectively.

Example 4 includes the circulator of Example 3, wherein the one or more quarter-wave dielectric transformers include a quarter-wave dielectric transformer extending into each waveguide arm respectively, wherein each step extends across a respective waveguide arm beneath the quarter-wave dielectric transformer extending into that respective waveguide arm.

Example 5 includes the circulator of Example 4, wherein each step is located in the range of 5 to 60 percent of the way along the quarter-wave dielectric transformer, where 0 percent is a first end of the quarter-wave dielectric transformer attached to the ferrite element and 100 percent is a distal end of the quarter-wave dielectric transformer furthest extended into the waveguide arm.

Example 6 includes the circulator of any of Examples 3-5, wherein the one or more quarter-wave dielectric transformers include a quarter-wave dielectric transformer extending into each waveguide arm respectively, wherein each step extends across a respective waveguide arm outward from a distal end of the quarter-wave dielectric transformer extending into that respective waveguide arm.

Example 7 includes the circulator of any of Examples 1-6, wherein the at least one step includes at least one first step in the ceiling and at least one second step in the floor, the at least one first step disposed in the ceiling opposite the at least one second step.

Example 8 includes the circulator of any of Examples 1-7, wherein the at least one step extends in a closed loop around a center of the central cavity, such that the first region is within the closed loop and the one or more second regions are outside the closed loop.

Example 9 includes the circulator of Example 8, wherein the at least one step is disposed beneath the distal end of respective arms of the ferrite element.

Example 10 includes the circulator of any of Examples 8-9, wherein the one or more quarter-wave dielectric transformers include a quarter-wave dielectric transformer extending into each waveguide arm respectively, wherein the at least one step is disposed beneath the quarter-wave dielectric transformer extending into each respective waveguide arm.

Example 11 includes a waveguide circulator comprising: a waveguide housing including a floor, a ceiling, and a plurality of sidewalls connected between the floor and the ceiling, the floor, ceiling, and plurality of sidewalls defining a central chamber and three hollow waveguide arms extending from and equi-angularly spaced around the central cavity, wherein at least one of the floor or the ceiling includes at least one step that defines a junction between a first region having a first height and one or more second regions having a second height, the first region including at least half of the central cavity and the one or more second regions including at least half of the waveguide arms, wherein the first height is larger than the second height; a ferrite element disposed in the central cavity of the waveguide housing, the ferrite element including three arms extending toward respective waveguide arms; and three quarter-wave dielectric transformers attached to respective arms of the ferrite element, each quarter-wave dielectric transformer extending from a respective arm of the ferrite element into a corresponding waveguide arm.

Example 12 includes the waveguide circulator of Example 11, wherein the second height is between 50 and 95 percent of the first height.

Example 13 includes the waveguide circulator of any of Examples 11-12, wherein the at least one step includes three steps in the floor or the ceiling respectively, each step extending across a respective waveguide arm from a first sidewall of the respective waveguide arm to a second sidewall of the respective waveguide arm, the second sidewall opposite the first sidewall, each step extending such that the first region includes all of the central cavity and the one or more second regions include a region in each waveguide arm respectively.

Example 14 includes the waveguide circulator of Example 13, wherein each step extends across a respective waveguide arm beneath the quarter-wave dielectric transformer extending into that respective waveguide arm.

Example 15 includes the waveguide circulator of Example 14, wherein each step is located in the range of 5 to 60 percent of the way along the quarter-wave dielectric transformer, where 0 percent is a first end of the quarter-wave dielectric transformer attached to the ferrite element and 100 percent is a distal end of the quarter-wave dielectric transformer furthest extended into the waveguide arm.

Example 16 includes the waveguide circulator of any of Examples 13-15, wherein each step extends across a respective waveguide arm outward from a distal end of the quarter-wave dielectric transformer extending into that respective waveguide arm.

Example 17 includes the waveguide circulator of any of Examples 11-16, wherein the at least one step includes at least one first step in the ceiling and at least one second step in the floor, the at least one first step disposed in the ceiling opposite the at least one second step.

Example 18 includes the waveguide circulator of any of Examples 11-17, wherein the at least one step extends in a closed loop around a center of the central cavity, such that the first region is within the closed loop and the one or more second regions are outside the closed loop.

Example 19 includes the waveguide circulator of Example 18, wherein the at least one step is disposed beneath the distal end of respective arms of the ferrite element.

Example 20 includes the waveguide circulator of any of Examples 18-19, wherein the at least one step is disposed beneath the quarter-wave dielectric transformer extending into each respective waveguide arm.

What is claimed is:

1. A circulator comprising:

a waveguide housing having a plurality of hollow waveguide arms that communicate with a central cavity, wherein the waveguide arms include, and the central cavity is defined by, a floor, a ceiling, and a plurality of sidewalls connected between the floor and the ceiling, wherein at least one of the floor or the ceiling includes at least one step which defines a junction between a first region having a first height between the floor and the ceiling and one or more second regions having a second height between the floor and the ceiling, the first region proximate the central cavity and the one or more second regions proximate the waveguide arms, wherein the first height is larger than the second height;

a ferrite element disposed in the central cavity of the waveguide housing, the ferrite element including a plurality of arms corresponding to the plurality of hollow waveguide arms; and one or more quarter-wave dielectric transformers attached to the ferrite element, each quarter-wave dielectric transformer protruding from a respective arm of the ferrite element into a respective waveguide arm, the one or more quarter-wave dielectric transformers proximate the at least one step.

2. The circulator of claim 1, wherein the second height is between 50 and 95 percent of the first height.

3. The circulator of claim 1, wherein the at least one step includes at least one first step in the ceiling and at least one second step in the floor, the at least one first step disposed in the ceiling opposite the at least one second step.

4. The circulator of claim 1, wherein the at least one step includes a plurality of steps in the floor or the ceiling respectively, each step extending across a respective waveguide arm from a first sidewall of the respective waveguide arm to a second sidewall of the respective waveguide arm, the second sidewall opposite the first sidewall, each step extending such that the first region includes all of the central cavity and the one or more second regions include a region in each waveguide arm respectively.

5. The circulator of claim 4, wherein the one or more quarter-wave dielectric transformers include a quarter-wave dielectric transformer extending into each waveguide arm respectively, wherein each step extends across a respective waveguide arm outward from a distal end of the quarter-wave dielectric transformer extending into that respective waveguide arm.

6. The circulator of claim 4, wherein the one or more quarter-wave dielectric transformers include a quarter-wave dielectric transformer extending into each waveguide arm respectively, wherein each step extends across a respective waveguide arm beneath the quarter-wave dielectric transformer extending into that respective waveguide arm.

7. The circulator of claim 6, wherein each step is located in the range of 5 to 60 percent of the way along the quarter-wave dielectric transformer, where 0 percent is a first end of the quarter-wave dielectric transformer attached to the ferrite element and 100 percent is a distal end of the quarter-wave dielectric transformer furthest extended into the waveguide arm.

8. The circulator of claim 1, wherein the at least one step extends in a closed loop around a center of the central cavity, such that the first region is within the closed loop and the one or more second regions are outside the closed loop.

9. The circulator of claim 8, wherein the at least one step is disposed beneath the distal end of respective arms of the ferrite element.

10. The circulator of claim 8, wherein the one or more quarter-wave dielectric transformers include a quarter-wave dielectric transformer extending into each waveguide arm respectively, wherein the at least one step is disposed beneath the quarter-wave dielectric transformer extending into each respective waveguide arm.

11. A waveguide circulator comprising:

a waveguide housing including a floor, a ceiling, and a plurality of sidewalls connected between the floor and the ceiling, the floor, ceiling, and plurality of sidewalls defining a central chamber and three hollow waveguide arms extending from and equi-angularly spaced around the central cavity, wherein at least one of the floor or the ceiling includes at least one step that defines a junction between a first region having a first height and one or more second regions having a second height, the first region including at least half of the central cavity and the one or more second regions including at least half of the waveguide arms, wherein the first height is larger than the second height;

a ferrite element disposed in the central cavity of the waveguide housing, the ferrite element including three arms extending toward respective waveguide arms; and three quarter-wave dielectric transformers attached to respective arms of the ferrite element, each quarter-wave dielectric transformer extending from a respective arm of the ferrite element into a corresponding waveguide arm.

12. The waveguide circulator of claim 11, wherein the second height is between 50 and 95 percent of the first height.

13. The waveguide circulator of claim 11, wherein the at least one step includes at least one first step in the ceiling and at least one second step in the floor, the at least one first step disposed in the ceiling opposite the at least one second step.

14. The waveguide circulator of claim 11, wherein the at least one step includes three steps in the floor or the ceiling respectively, each step extending across a respective waveguide arm from a first sidewall of the respective waveguide arm to a second sidewall of the respective waveguide arm, the second sidewall opposite the first sidewall, each step extending such that the first region includes all of the central cavity and the one or more second regions include a region in each waveguide arm respectively.

15. The waveguide circulator of claim 14, wherein each step extends across a respective waveguide arm outward from a distal end of the quarter-wave dielectric transformer extending into that respective waveguide arm.

16. The waveguide circulator of claim 14, wherein each step extends across a respective waveguide arm beneath the quarter-wave dielectric transformer extending into that respective waveguide arm.

17. The waveguide circulator of claim 16, wherein each step is located in the range of 5 to 60 percent of the way along the quarter-wave dielectric transformer, where 0 percent is a first end of the quarter-wave dielectric transformer attached to the ferrite element and 100 percent is a distal end of the quarter-wave dielectric transformer furthest extended into the waveguide arm.

18. The waveguide circulator of claim 11, wherein the at least one step extends in a closed loop around a center of the central cavity, such that the first region is within the closed loop and the one or more second regions are outside the closed loop.

19. The waveguide circulator of claim 18, wherein the at least one step is disposed beneath the distal end of respective arms of the ferrite element.

20. The waveguide circulator of claim 18, wherein the at least one step is disposed beneath the quarter-wave dielectric transformer extending into each respective waveguide arm.

* * * * *